US007611590B2

(12) United States Patent
Liang

(10) Patent No.: US 7,611,590 B2
(45) Date of Patent: Nov. 3, 2009

(54) WEAR RESISTANT ALLOY FOR VALVE SEAT INSERT USED IN INTERNAL COMBUSTION ENGINES

(75) Inventor: Xuecheng Liang, Green Bay, WI (US)

(73) Assignee: Alloy Technology Solutions, Inc., Marinette, WI (US)

( * ) Notice: Subject to any disclaimer, the term of this patent is extended or adjusted under 35 U.S.C. 154(b) by 358 days.

(21) Appl. No.: 11/159,548

(22) Filed: Jun. 23, 2005

(65) Prior Publication Data

US 2006/0283526 A1 Dec. 21, 2006

Related U.S. Application Data

(60) Provisional application No. 60/586,494, filed on Jul. 8, 2004.

(51) Int. Cl.
*C22C 38/44* (2006.01)
*C21D 9/00* (2006.01)

(52) U.S. Cl. ..... 148/324; 148/325; 148/335; 148/442; 148/663; 420/10; 420/12; 420/17

(58) Field of Classification Search ..... 148/333–335, 148/324, 325, 326, 321, 328, 663, 442; 75/255, 75/246; 420/104–114, 9–17, 38, 67, 69, 420/586.1
See application file for complete search history.

(56) References Cited

U.S. PATENT DOCUMENTS

| | | | | |
|---|---|---|---|---|
| 1,556,776 | A | | 10/1925 | Flietermann |
| 1,599,425 | A | | 9/1926 | McGuire |
| 1,729,245 | A | | 9/1929 | Chace |
| 1,759,477 | A | | 5/1930 | Armstrong et al. |
| 1,760,326 | A | | 5/1930 | Stablein |
| 1,818,054 | A | | 8/1931 | Elmen |
| 1,876,411 | A | | 9/1932 | Gregg et al. |
| 2,099,509 | A | | 11/1937 | Blessing |
| 2,113,937 | A | | 4/1938 | Franks |
| 2,136,946 | A | | 11/1938 | McCurdy |
| 2,159,723 | A | | 5/1939 | Franks |
| 2,590,835 | A | | 4/1952 | Kirkby et al. |
| 2,602,736 | A | | 7/1952 | Sheridan et al. |
| 2,693,413 | A | | 11/1954 | Kirkby et al. |
| 2,793,113 | A | | 5/1957 | Ralt et al. |
| 2,809,109 | A | | 10/1957 | Field |
| 3,257,178 | A | | 6/1966 | Severns, Jr. |
| 3,295,966 | A | | 1/1967 | Steven |
| 3,410,732 | A | | 11/1968 | Smith |
| 3,756,808 | A | | 9/1973 | Webster |
| 3,850,621 | A | | 11/1974 | Haberling et al. |
| 3,859,147 | A | | 1/1975 | Philip |
| 3,873,378 | A | | 3/1975 | Webster |
| 3,876,447 | A | | 4/1975 | Lally |
| 4,021,205 | A | | 5/1977 | Matsuda et al. |
| 4,075,999 | A | | 2/1978 | Danis |
| 4,104,505 | A | | 8/1978 | Rayment et al. |
| 4,122,817 | A | | 10/1978 | Matlock |
| 4,155,754 | A | | 5/1979 | Lynn |
| 4,191,562 | A | | 3/1980 | Silence |
| 4,224,060 | A | | 9/1980 | de Souza et al. |
| 4,228,223 | A | | 10/1980 | Knotek et al. |
| 4,279,074 | A | | 7/1981 | Zell et al. |
| 4,292,074 | A | | 9/1981 | Komiyama et al. |
| 4,363,660 | A | | 12/1982 | Wakita et al. |
| 4,430,297 | A | | 2/1984 | Crook |
| 4,568,393 | A | | 2/1986 | Kane et al. |
| 4,724,000 | A | | 2/1988 | Larson et al. |
| 4,729,872 | A | | 3/1988 | Kishida et al. |
| 4,778,522 | A | | 10/1988 | Maki et al. |
| 4,810,464 | A | | 3/1989 | Szereto et al. |
| 4,822,695 | A | | 4/1989 | Larson et al. |
| 4,844,024 | A | | 7/1989 | Fujiki et al. |
| 4,880,461 | A | * | 11/1989 | Uchida ..... 75/238 |
| 4,902,473 | A | | 2/1990 | Arata et al. |
| 4,929,419 | A | | 5/1990 | Wegman et al. |
| 5,041,158 | A | | 8/1991 | Larson |

(Continued)

FOREIGN PATENT DOCUMENTS

| | | |
|---|---|---|
| DE | 1023781 | 2/1958 |

(Continued)

OTHER PUBLICATIONS

Strong et al., "A review of valve seat insert material properties required for success," *Proc. of the International Symposium on Valvetrain Design and Materials*, Apr. 14, 1997, pp. 121-127.

(Continued)

*Primary Examiner*—Deborah Yee
(74) *Attorney, Agent, or Firm*—Brinks Hofer Gilson & Lione; Steven P. Shurtz

(57) ABSTRACT

This invention related to a high carbon and high molybdenum/tungsten martenisitic type iron base alloy with excellent hot hardness and wear resistance for making valve seat insert. The alloy comprises of 2.05-3.60 wt % carbon, 0.1-3.0 wt % silicon, 0-2.0 wt % manganese, 3.0-10.0 wt % chromium, 11.0-25.0 wt % molybdenum and tungsten, 0.1-6.5 wt % nickel, 0-8.0 wt % vanadium, 0-6.0 wt % niobium, 0-8.0 wt % cobalt, and the balance being iron with impurities.

31 Claims, No Drawings

U.S. PATENT DOCUMENTS

| | | | | |
|---|---|---|---|---|
| 5,116,571 | A | 5/1992 | Abe et al. | |
| 5,147,475 | A | 9/1992 | Holmberg | |
| 5,194,221 | A | 3/1993 | Culling | |
| 5,221,373 | A | 6/1993 | Schuler et al. | |
| 5,225,007 | A * | 7/1993 | Hattori et al. | 148/541 |
| 5,246,661 | A | 9/1993 | Culling | |
| 5,292,382 | A | 3/1994 | Longo | |
| 5,316,596 | A | 5/1994 | Kataoka | |
| 5,360,592 | A | 11/1994 | Culling | |
| 5,458,703 | A | 10/1995 | Nakai | |
| 5,578,773 | A | 11/1996 | Wisell | |
| 5,674,449 | A | 10/1997 | Liang et al. | |
| 6,200,688 | B1 | 3/2001 | Liang et al. | |
| 6,248,292 | B1 | 6/2001 | Ando et al. | |
| 6,436,338 | B1 | 8/2002 | Qiao | |
| 6,485,678 | B1 | 11/2002 | Liang et al. | |
| 6,702,905 | B1 | 3/2004 | Qiao et al. | |
| 6,723,182 | B1 * | 4/2004 | Bahmiller | 148/326 |
| 6,866,816 | B2 | 3/2005 | Liang et al. | |
| 6,916,444 | B1 * | 7/2005 | Liang | 420/10 |

FOREIGN PATENT DOCUMENTS

| | | | |
|---|---|---|---|
| DE | 1142002 | B | 1/1963 |
| DE | 2929811 | | 2/1980 |
| DE | 2913221 | A1 | 10/1980 |
| DE | 103 05 568 | A1 | 8/2003 |
| EP | 0264528 | | 4/1988 |
| EP | 0430241 | A1 | 6/1991 |
| EP | 0559899 | A1 | 9/1993 |
| EP | 0665068 | A1 | 8/1995 |
| EP | 1108800 | | 6/2001 |
| FR | 2835850 | | 8/2003 |
| GB | 553397 | | 5/1943 |
| GB | 741053 | | 11/1955 |
| GB | 1406696 | | 9/1975 |
| GB | 1567524 | | 5/1980 |
| JP | 48052619 | | 7/1973 |
| JP | 48102717 | | 12/1973 |
| JP | 55-145156 | | 11/1980 |
| JP | 57-130714 | | 8/1982 |
| JP | 57-203753 | | 12/1982 |
| JP | 59-229465 | | 12/1984 |
| JP | 60-258449 | | 12/1985 |
| JP | 02015149 | | 1/1990 |
| JP | 02015150 | | 1/1990 |
| JP | 2-30730 | | 2/1990 |
| JP | 3-13542 | | 1/1991 |
| JP | 05179394 | | 7/1993 |
| JP | 6-256889 | | 9/1994 |
| JP | 8-209299 | | 8/1996 |
| JP | 1068041 | | 3/1998 |
| JP | 11061320 | | 3/1999 |
| JP | 2000-28009 | | 10/2000 |

OTHER PUBLICATIONS

Strong, G. (Winsert) Database Metadex "Online! Materials Information, The Institute of Metals, London, GB; "Iron-base alloy replaces cobalt in auto engines." Retrieved from STN Database accession No. 61-115 XP 002183696, abstract; from Advanced Materials & Processes (1999) 156 (4), 67-68.

* cited by examiner

WEAR RESISTANT ALLOY FOR VALVE SEAT INSERT USED IN INTERNAL COMBUSTION ENGINES

RELATED APPLICATION

This application claims the benefit of the filing date of U.S. provisional application No. 60/586,494, filed Jul. 8, 2004

BACKGROUND OF THE INVENTION

1. Field of Invention

This invention relates to a cast wear resistant martensitic type iron base alloy containing high carbon, high molybdenum and/or tungsten and other alloy elements like vanadium and niobium, to improve hot hardness and wear resistance for making internal combustion engine valve seat inserts (VSI), where carbon is in the range of 2.05-3.60 wt. % and molybdenum plus tungsten is in the range of 11.0-25.0 wt %. The inventive alloy is especially useful to make exhaust VSIs used in heavy duty internal combustion engines where the working conditions are severe enough to demand for VSI alloys with excellent wear resistance. On the other hand, this alloy also relates to high carbon and high alloy type steels and cast irons. In a further aspect, this invention relates to components made from such alloys, either cast or hardfaced. Alternatively, components made of such alloys may be made by conventional powder metallurgy methods either by cold pressing and sintering or by hot pressing at elevated pressures for wear resistant applications.

2. Prior Art

High temperature wear resistance is the most important property for exhaust VSI alloys used in internal combustion engines, where the average exhaust VSI seat surface working temperature is 550-950° F. Hot hardness or high temperature hardness is one of the key factors affecting wear resistance of exhaust VSI materials. Iron, nickel and cobalt base alloys are the most common alloy families used for making exhaust VSIs in diesel or dry fuel internal combustion engines. High carbon and high chromium type nickel base alloys were developed in 1970s as disclosed in U.S. Pat. No. 4,075,999 to replace Stellite type cobalt base alloy as exhaust VSI materials, and these nickel base alloys are still in use in less demanding engine applications. Because of their relatively lower cost, iron base alloys, like M2 tool steel, are also found their applications as VSI materials in many diesel engines where the working conditions are within the performance range of these iron base alloys. In the early 1990s, a high speed type iron base alloy was developed and the subject of U.S. Pat. No. 5,674,449, to fill the gap between nickel base alloys and cobalt base alloys as exhaust VSI material. It was the first VSI alloy utilizing alloy element niobium with higher amount of molybdenum, tungsten and chromium, etc. to improve wear and oxidation resistance. Because of its high performance-to-cost ratio, this alloy has been widely used as an exhaust VSI material in diesel engine industry. Wear resistant alloy carbides with tempered martensitic matrix and adequate oxidation resistance are the essential factors for good wear resistance of the iron base alloy.

U.S. Pat. No. 5,674,449 discloses an alloy in which carbon is 1.6-2.0%, chromium 6.0-9.0%, the total of molybdenum plus tungsten is 11.0-14.0%, vanadium 1.0-8.0%, niobium 0.5-5.0%, cobalt 2.0-12.0%, and iron being balance.

U.S. Pat. No. 6,702,905 discloses an iron base alloy as diesel engine VSI material. This alloy contains carbon 1.2-1.8%, boron 0.005-0.5%, vanadium 0.7-1.5%, chromium 7-11%, niobium 1-3.5%, molybdenum 6-11%, and the balance including iron and incidental impurities.

U.S. Pat. No. 6,436,338 discloses another iron base alloy for diesel engine VSI applications. The alloy composes of carbon 1.1-1.4%, chromium 11-14.5%, molybdenum 4.75-6.25%, tungsten 3.5-4.5%, cobalt 0-3%, niobium 1.5-2.5%, anadium 1-1.75%, copper 0-2.5%, silicon 0-1%, nickel 0-0.8%, iron being the balance with impurities.

U.S. Pat. No. 6,866,816 discloses an austenitic type iron base alloy with good corrosion resistance. The chemical composition of the alloy is 0.7-2.4% carbon, 1.5-4.0% silicon, 3.0-9.0% chromium, less than 6.0% manganese, 5.0-20.0% molybdenum and tungsten, the total of vanadium and niobium 0-4.0%, titanium 0-1.5%, aluminum 0.01-0.5%, nickel 12.0-25.0%, copper 0-3.0%, and at least 45.0% iron.

U.S. application Ser. No. 10/074,068 discloses another type of wear resistant alloy containing residual austenite as VSI material. This alloy contains 2.0-4.0% carbon, 3.0-9.0% chromium, 0.0-4.0% manganese, 5.0-15.0% molybdenum, 0.0-6.0% tungsten, 0.0-6.0% vanadium, 0.0-4.0 niobium, 7.0-15.0% nickel, 0.0-6.0% cobalt, and the balance being iron with impurities.

However, the VSI material disclosed in these patents do not exhibit a sufficiently high wear resistance required for many new internal combustion engines which have higher power output and combustion pressure and produce less emission. Also, the hot hardness and wear resistance of the VSI material disclosed in these patents is not high enough for these new engines. Although cobalt base alloys like Stellite® 3 or Tribaloy© T-400 offer adequate hot hardness and wear resistance as VSI materials in certain demanding applications, the high cost of cobalt element limits these cobalt base alloys to be widely accepted in the engine industry. On the other hand, as the alloy content in iron base alloys reaches a fairly high level, like in U.S. Pat. No. 5,674,449, manufacturing cost becomes a significant factor to determine if the iron base alloys will be competitive in performance to cost ratio compared to cobalt base alloys. The casting VSI manufacturing cost is affected by casting scrap rate, alloy heat treatment cost, machining ability, and inspection of these casting wear resistant alloys etc. For a given casting technique, the casting scrap rate and heat treatment response are directly affected by alloy chemical compositions. Though VSI machining ability is also affected by the alloy chemical composition it is difficult to achieve good wear resistance and good machining ability at the same time in this group of alloy.

BRIEF SUMMARY OF THE INVENTION

It is an object of this invention to develop an iron base alloy with an acceptable casting scrap rate and good heat treatment characteristics.

Another object is an iron base alloy with excellent wear resistance and good hot hardness for VSI application.

The new iron base alloy contains a large amount of refractory alloy elements, like molybdenum and tungsten, to provide better hot hardness and therefore better high temperature wear resistance. The hot hardness of the inventive alloy is significantly higher than current martensitic type iron base VSI alloys due to its large amount of alloy carbides embedded in a tempered martensitic matrix. The solid solution strengthened matrix is one of the most important factors contributing to the excellent hot hardness of the inventive alloy. The existence of a large amount of alloy carbides in the solid solution strengthened matrix increases the hardness of the inventive alloys at high temperature while the alloyed matrix also provides better resistance against softening at high temperatures.

A better hot hardness is a necessary condition to achieve excellent wear resistance as common VSI wear mechanisms involve plastic deformation and indentation processes. On the other hand, this high alloy iron base alloy also has an acceptable casting scrap rate and good heat treatment characteristics so that it is possible to achieve a lower manufacturing cost.

The present invention is an alloy with the following composition:

| Element | wt. % |
|---|---|
| Carbon | 2.05-3.60 |
| Silicon | 0.1-3.0 |
| Chromium | 3.0-10.0 |
| Manganese | up to 2.0 |
| Molybdenum + Tungsten | 11.0-25.0 |
| Vanadium | 0.0-8.0 |
| Niobium | 0.0-6.0 |
| Nickel | 0.1-6.5 |
| Cobalt | 0-8.0 |
| Iron | balance |

Additionally, a small amount of strong carbide forming elements like titanium, zirconium, hafnium, and tantalum may be added to the inventive alloys, and each one of them is limited to less than 1.0 wt %. Aluminum may be used as degassing element when melting this alloy. The amount of aluminum in the inventive alloy is less than 0.5 wt %. Whether in raw materials or added as alloy elements, boron, lead, tin, and bismuth should be limited to 0.5 wt % in order to ensure mechanical and other useful properties of the inventive alloys. Phosphors and sulfur are harmful to casting properties of the inventive alloys. These two elements should be limited to less than 0.2 wt %. Other trace amount of elements may exist in the inventive alloys as impurities from raw materials.

In another aspect of the invention, metal components are either made of the alloy, such as by casting or powder metallurgy method by forming from a powder and sintering. Furthermore, the alloy is used to hardface the components as the protective coating.

DETAILED DESCRIPTION OF THE INVENTION

The microstructure of most traditional VSI iron base alloys, like high speed steels and high chromium type alloys, consists of hard alloy carbides and tempered martensite matrix to achieve good wear resistance. The tempered martensite is also strengthened by solution atoms like chromium, tungsten, molybdenum and chromium, etc. The design principle of high speed steels has been proved to be effective to obtain high wear resistance in different cutting tools where high room temperature hardness and hot hardness are essential to retain a sharp edge during cutting operation. The high hardness is obtained through quenching and later secondary hardening at tempering process in the alloys. However, carbon content in these standard high speed steels are general less than 2.0% and these steels also do not contain any nickel as nickel intends to increase and stabilize residual austenite that will decrease maximum hardness attainable through heat treatment.

Since wear of exhaust VSI material in diesel engines is the result of relative mechanical motion between valve seating surface and insert seating surface, which is characterized as high frequent normal contacting plus small amplitude sliding from valve head deflection under high contact pressure with the influence of high temperature and combustion deposits. Oxidation, plastic deformation and metal to metal wear resistance under boundary lubrication condition are important material parameters affecting the service life of VSI. VSI materials with good hot hardness are a basic requirement in order to utilize the above material properties for high temperature and more severe conditions. Traditionally, a certain amount of cobalt was added to increase hot hardness of high speed steels, and the amount of cobalt contained in these steels is normally around 5.0% but can be up to 15.0% in special cases. Through extensive experimental studies, we found that increasing carbon and refractory alloy elements further improves hot hardness in the inventive alloys. Addition of a small amount of nickel is beneficial to hot hardness of the inventive alloys. Nickel also improves oxidation resistance of the matrix. However, nickel stabilizes residual austenite in as cast state, and the negative effect on heat treatment is offset by using a certain amount of other alloy elements in the inventive alloys. It is found that addition of niobium also has a positive effect on the hot hardness of the inventive alloys. Chromium is another element contributing to good hot hardness and also improves casting scrap rate of the inventive alloys.

Using a large volume fraction of alloy carbide is also beneficial to the wear resistance of the inventive alloys. Besides forming wear resistant refractory carbides and strengthening matrix, a higher concentration of molybdenum and/or tungsten helps to form an oxide film with reduced frictional coefficient in VSI operated at high temperature, which is beneficial to the wear resistance of the inventive alloys.

Listed in table 1 below are sample alloys with the nominal compositions indicated. The sample alloys were cast and machined for heat treatment response, scrap rate tendency, wear and hot hardness tests.

TABLE 1

| | | Sample Alloy Chemical Composition (wt. %) | | | | | | | | | | |
|---|---|---|---|---|---|---|---|---|---|---|---|---|
| Sample Alloy | | C | Si | Mn | Cr | Mo | W | Fe | V | Nb | Ni | Co |
| 1 | comparative | 1.80 | 2.0 | 0.4 | 6.0 | 5.0 | | Bal. | 5.0 | 2.0 | — | |
| 2 | comparative | 2.40 | 2.0 | 0.4 | 6.0 | 5.0 | | Bal. | 4.0 | — | 3.0 | |
| 3 | comparative | 2.40 | 2.0 | 0.4 | 6.0 | 5.0 | | Bal. | 4.0 | — | 6.0 | |
| 4 | comparative | 2.40 | 2.0 | 0.4 | 6.0 | 5.0 | | Bal. | 5.0 | 1.0 | 3.0 | |
| 5 (M2) | comparative | 1.60 | 0.4 | 0.4 | 4.0 | 6.5 | 5.5 | Bal. | 1.5 | | | |
| 6 | comparative | 1.80 | 0.5 | 0.5 | 8.0 | 11.0 | 1.0 | Bal. | 4.0 | 1.0 | | 4.0 |
| 7 (Eatonite 6) | comparative | 1.60 | 1.2 | 0.7 | 30.0 | 5.0 | | Bal. | | | 16.5 | |
| 8 | | 2.40 | 2.0 | 0.4 | 6.0 | 15.0 | | Bal. | 1.5 | — | 3.0 | |
| 9 | | 3.00 | 2.0 | 0.4 | 6.0 | 20.0 | | Bal. | 1.0 | 1.0 | 0.2 | |
| 10 | | 2.40 | 1.5 | 0.4 | 8.0 | 16.0 | | Bal. | 6.0 | 1.0 | 5.0 | |
| 11 | | 2.40 | 1.5 | 0.4 | 8.0 | 16.0 | | Bal. | 4.0 | 0.5 | 5.0 | |

TABLE 1-continued

| Sample Alloy | C | Si | Mn | Cr | Mo | W | Fe | V | Nb | Ni | Co |
|---|---|---|---|---|---|---|---|---|---|---|---|
| | Sample Alloy Chemical Composition (wt. %) | | | | | | | | | | |
| 12 | 2.40 | 1.5 | 0.4 | 8.0 | 18.0 | | Bal. | 4.0 | 1.0 | 5.0 | |
| 13 | 2.40 | 1.5 | 0.4 | 8.0 | 16.0 | | Bal. | 4.0 | 1.5 | 5.0 | |
| 14 | 2.40 | 1.5 | 0.4 | 8.0 | 16.0 | | Bal. | 4.0 | 2.5 | 5.0 | |
| 15 | 2.40 | 1.5 | 0.4 | 8.0 | 16.0 | | Bal. | 4.0 | 3.0 | 5.0 | |
| 16 | 2.40 | 1.5 | 0.4 | 8.0 | 16.0 | | Bal. | 4.0 | 4.0 | 5.0 | |
| 17 | 2.40 | 1.5 | 0.4 | 8.0 | 12.0 | 4.0 | Bal. | 5.0 | 0.5 | 5.0 | |
| 18 | 2.50 | 1.5 | 0.4 | 6.0 | | 16.0 | Bal. | 3.0 | 4.0 | 5.0 | |
| 19 | 2.40 | 1.5 | 0.4 | 8.0 | 16.0 | | Bal. | 4.0 | 1.5 | 0.5 | |
| 20 | 2.40 | 1.5 | 0.4 | 8.0 | 16.0 | | Bal. | 4.0 | 1.5 | 1.0 | |
| 21 | 2.40 | 1.5 | 0.4 | 8.0 | 16.0 | | Bal. | 4.0 | 1.5 | 2.0 | |
| 22 | 2.40 | 1.5 | 0.4 | 8.0 | 16.0 | | Bal. | 4.0 | 1.5 | 3.0 | |
| 23 | 2.40 | 1.5 | 0.4 | 8.0 | 16.0 | | Bal. | 4.0 | 1.5 | 4.0 | |
| 24 | 2.40 | 1.5 | 0.4 | 8.0 | 16.0 | | Bal. | 4.0 | 1.5 | 6.0 | |
| 25 | 2.05 | 1.5 | 0.4 | 8.0 | 16.0 | | Bal. | 4.0 | 1.5 | 5.0 | |
| 26 | 2.10 | 1.5 | 0.4 | 8.0 | 16.0 | | Bal. | 4.0 | 1.5 | 5.0 | |
| 27 | 2.20 | 1.5 | 0.4 | 8.0 | 16.0 | | Bal. | 4.0 | 1.5 | 5.0 | |
| 28 | 2.30 | 1.5 | 0.4 | 8.0 | 16.0 | | Bal. | 4.0 | 1.5 | 5.0 | |
| 29 | 2.60 | 1.5 | 0.4 | 8.0 | 16.0 | | Bal. | 4.0 | 1.5 | 5.0 | |
| 30 | 2.80 | 1.5 | 0.4 | 8.0 | 16.0 | | Bal. | 4.0 | 1.5 | 5.0 | |
| 31 | 3.00 | 1.5 | 0.4 | 8.0 | 16.0 | | Bal. | 4.0 | 1.5 | 5.0 | |
| 32 | 3.20 | 1.5 | 0.4 | 8.0 | 16.0 | | Bal. | 4.0 | 1.5 | 5.0 | |
| 33 | 3.40 | 1.5 | 0.4 | 8.0 | 16.0 | | Bal. | 4.0 | 1.5 | 5.0 | |
| 34 | 2.40 | 1.5 | 0.4 | 8.0 | | 16.0 | Bal. | 4.0 | 1.5 | 5.0 | |
| 35 | 2.40 | 1.5 | 0.4 | 8.0 | 2.0 | 14.0 | Bal. | 4.0 | 1.5 | 5.0 | |
| 36 | 2.40 | 1.5 | 0.4 | 8.0 | 14.0 | 2.0 | Bal. | 4.0 | 1.5 | 5.0 | |
| 37 | 2.40 | 1.5 | 0.4 | 3.0 | 16.0 | | Bal. | 4.0 | 1.5 | 5.0 | |
| 38 | 2.40 | 1.5 | 0.4 | 5.0 | 16.0 | | Bal. | 4.0 | 1.5 | 5.0 | |
| 39 | 2.40 | 1.5 | 0.4 | 10.0 | 16.0 | | Bal. | 4.0 | 1.5 | 5.0 | |
| 40 | 2.40 | 1.5 | 0.4 | 8.0 | 16.0 | | Bal. | 4.0 | 1.5 | 5.0 | 2.0 |
| 41 | 2.40 | 1.5 | 0.4 | 8.0 | 16.0 | | Bal. | 4.0 | 1.5 | 5.0 | 4.0 |
| 42 | 2.40 | 1.5 | 0.4 | 8.0 | 16.0 | | Bal. | 4.0 | 1.5 | 5.0 | 8.0 |
| 43 | 2.40 | 1.5 | 0.4 | 8.0 | 14.0 | | Bal. | 4.0 | 1.5 | 5.0 | |
| 44 | 2.40 | 1.5 | 0.4 | 8.0 | 12.0 | | Bal. | 4.0 | 1.5 | 5.0 | |
| 45 | 2.40 | 0.5 | 0.4 | 8.0 | 16.0 | | Bal. | 4.0 | 1.5 | 5.0 | |

Sample alloys 1-7 are comparative example alloys in which their chemical compositions are out of the claimed ranges.

A pin-on-disk wear tester was used to measure the sliding wear resistance of the alloy samples. Sliding wear is an important consideration in the wear mechanism of VSIs due to relative sliding motion that occurs between the valves and VSIs in internal combustion engines. The pin specimen was 6.35 mm in diameter and approximately 24.5 mm long and was made of Eatonite 6, a common valve alloy used for diesel engines. The disks were made of insert alloys with dimensions of 50.8 mm in diameter and 12.5 mm thickness. The testing temperature was 800° F. (427° C.), as the exhaust VSIs normally work at this temperature. The tests were performed with reference to ASTM G99-90. The disk samples were rotated at a velocity of 0.13 m/s for a total sliding distance of 255 m. The weight loss was measured on both the pin and the disk samples after each test using a balance with 0.1 mg precision. The high temperature pin-on-disk wear test results of some sample alloys are listed in table 2. Alloys with less weight loss have better wear resistance than alloys with higher weight loss. The weight loss of each inventive alloy in table 2 is less than comparative sample alloy No. 5. Sample alloys with higher carbon content exhibit less weight loss in pin-on-disk wear testing.

TABLE 2

| Sample Alloy | Total Weight Loss (mg) |
|---|---|
| High Temperature Pin-on-Disk Test Results | |
| 5 | 22.9 |
| 10 | 10.0 |
| 13 | 11.1 |
| 25 | 11.7 |
| 28 | 10.2 |
| 30 | 8.1 |
| 32 | 7.0 |
| 33 | 5.7 |

A pulse wear tester was used to measure wear resistance under high frequent contact conditions similar to experienced by VSI in internal combustion engines. The principle of the pulse wear tester is described in a technical paper from Society of Automotive Engineers (1999-01-1319). A shaft with an upper pin specimen, made of valve or valve hardfacing alloy, moves up and down to generate contact motion driven by a camshaft while other motor drives insert shaft to generate sliding motion between valve and insert pin specimens. The pulse wear tests were carried out at 3000 psi contact pressure and 1000 contacts per minute in 427° C. temperatures conditions. Specimen length change is used to measure wear loss. Four Vickers indentation marks spaced at 90 degree are made for wear measurement. The diagonal length of each indentation mark is measured before and after wear test. Eatonite 6 was used as the pin alloy because it is a common valve facing alloy. Eatonite 6 is an austenitic iron base alloy developed by Eaton Corporation. The results from pulse wear tester indicate that the total wear loss from inventive sample alloy No 16 is much less than comparative sample alloy No. 6.

TABLE 3

Pulse Wear Test Results (427° C.)

| Sample Alloy | Total Wear Loss (μm) |
|---|---|
| 6 comparative | 111.1 |
| 16 | 75.0 |

A 60 pound induction furnace is used to melt different sample alloys, and about 200 pieces of ring shaped castings are made in shell sand molds. These castings were heat treated and then machined. The dimensions of the scrap test casting are 44 mm in outer diameter, 31 mm in inner diameter, and 7 mm in thickness. Any gas hole, slag hole, and slag inclusion are defined as casting defect. The scrap rate is equal to the percentage of scrap pieces divided by the total pieces of samples examined. Scrap rate of a sample alloy may not be exactly the same as its production scrap rate because of variation of melting and other casting process parameters and the different inspection quality standards. However, it provides an indication of influence of different alloy elements on the scrap rate. As shown in table 4, the casting scrap rates of these sample alloys are in a fairly reasonably range for high alloy castings.

TABLE 4

Casting Scrap Test Results

| Sample Alloy | Scrap Rate (%) |
|---|---|
| 17 | 16.1 |
| 19 | 12.1 |
| 20 | 13.3 |
| 22 | 10.7 |
| 24 | 15.0 |
| 29 | 16.9 |
| 35 | 11.7 |
| 36 | 11.9 |
| 41 | 17.5 |

Heat treatment is an essential process in the production of VSI using the inventive alloys. It is inevitable to have a certain amount of residual austenite in high speed steel type VSI in as-cast state as some alloy elements promote formation of residual austenite and also increase the stability of the residual austenite. The residual austenite must be removed to ensure VSI dimensional stability because any dimensional changes in VSI will cause distortion or fall-out problems. The residual austenite can transform into martensite under repeated heating and cooling cycles in engine operational condition, and carbides will precipitate from the newly formed martensite under high temperature. These two processes can lead to a significant dimensional change of VSI. Hence all residual austenite in VSI made from the inventive alloys must be changed during heat treatment processes in order to ensure high dimensional stability of VSI made from the inventive alloys. Because of higher alloy element content, like carbon, molybdenum, tungsten, and nickel, used to improve hot hardness and wear resistance in the present invention, these alloy elements can greatly increase residual austenite stability, and a more stable residual austenite increases heat treatment difficulties or even makes it impossible to transform the highly stabilized residual austenite in normal tempering process. Thus, it is important to evaluate if these example alloys are practical for normal heat treatment process like tempering.

A simple and effective magnetic balance testing method is used to evaluate heat treatment response of the inventive alloys by examining the stability of residual austenite in sample alloys. The higher the magnetic attractive force values after heat treatment the better the heat treatment response of a sample alloy. A ring-shaped sample is placed on a balance with precision to 0.01 gram and then an iron-neodymium-boron permanent magnet with dimensions of 3 mm diameter and 4 mm thickness is placed above the ring sample. The spacing between the magnet and the sample is 1.27 mm. The weight of each testing sample is recorded with or without the magnetic. The difference in weight with and without the magnet is the magnetic attraction force. Since residual austenite is ferr-magnetic and martensite is ferro-magnetic, the more residual austenite in a sample alloy, the less the magnetic attraction force. As shown in table 5, the magnetic force of fully heat treated M2 tool with 100% martensite matrix is about 160 gram while the magnetic force of an austenitic alloy with 100% austenite matrix is about 0.3 gram. To the first approximation, the content of martensite in a sample alloy can be estimated as being roughly proportional to the magnetic attraction force.

Table 5 lists results of magnetic test of some example alloys. All sample alloys tested are heat treated at 1200° F. for one hour and then air cool, a common condition used as first tempering treatment. The dimensions of the magnetic test ring specimen are 45 mm outer diameter, 32 mm inner diameter and 5 mm thickness. Magnetic attraction force is measured in as-cast state and after heat treatment.

Increasing nickel content can increase residual austenite stability as nickel content changes from 0.5 to 6.0 wt % in sample alloys No. 19 to 24, however, when nickel content is 6.0 wt % in example alloy 24 it is difficult to remove all residual austenite in tempering process because there is still a fair amount of residual austenite left after one hour at 1200° F. (649° C.) tempering treatment. Therefore, the upper limit of nickel content is set at 6.5 wt %. Beyond this limit it is difficult to remove all residual austenite in VSI in as-cast state through heat treatment. Carbon is another element with a strong effect on the stability of residual austenite. Residual austenite stability remains little changed with carbon content when carbon content changes from 2.05 to 2.30 wt %. Residual austenite becomes fairly stable when carbon content is in 2.60-3.40 wt %. Carbon is preferred to be less than 2.40 wt %. However, for hot hardness and wear resistance the upper limit of carbon is set at 3.60 wt %. Increasing niobium can decrease residual austenite stability as niobium increases from 0.5 to 4.0 wt %. The upper limit of niobium is set at 6.0 wt %. Chromium is another alloy element exhibiting strong influence on the stability of residual austenite found in the inventive alloys. Too much chromium makes residual austenite difficult to transform into martensite in the inventive alloys. The upper limit for chromium is 10.0 wt %. Contrary to the effect of cobalt in high speed steels, cobalt can stabilize the residual austenite in the inventive alloys.

TABLE 5

Heat Treatment Response Test Results (gram)

| Sample Alloy | As Cast | 1200 F., 1 HR |
|---|---|---|
| 1 | 157.3 | 176.1 |
| 2 | 31.7 | 147.3 |

TABLE 5-continued

| Heat Treatment Response Test Results (gram) | | |
|---|---|---|
| Sample Alloy | As Cast | 1200 F., 1 HR |
| 3 | 13.2 | 33.9 |
| 4 | 137.7 | 136.9 |
| 5 (M2) | 124.1 | 169.8 |
| 6 | 130.3 | 149.7 |
| 7 (Eatonite 6) | 0.3 | 0.3 |
| 8 | 12.1 | 118.7 |
| 9 | 26.0 | 133.3 |
| 10 | 87.7 | 157.6 |
| 11 | 7.8 | 58 |
| 12 | 19.1 | 45.7 |
| 13 | 30.7 | 126.6 |
| 14 | 32.9 | 119.3 |
| 15 | 22.8 | 100.3 |
| 16 | 144.6 | 131.0 |
| 17 | 42.5 | 135.7 |
| 18 | 5.8 | 15.8 |
| 19 | 108.9 | 149.4 |
| 20 | 108.1 | 146.2 |
| 21 | 91.8 | 147.4 |
| 22 | 73.7 | 144.5 |
| 23 | 29.1 | 108.9 |
| 24 | 6.8 | 37.1 |
| 25 | 48.3 | 119.9 |
| 26 | 48.0 | 126.6 |
| 27 | 31.8 | 115.1 |
| 28 | 30.4 | 110.4 |
| 29 | 6.0 | 42.6 |
| 30 | 3.6 | 33.9 |
| 31 | 3.0 | 38.0 |
| 32 | 11.1 | 39.1 |
| 33 | 15.3 | 42.0 |
| 34 | 9.8 | 29.4 |
| 35 | 9.2 | 32.9 |
| 36 | 15.9 | 74.8 |
| 37 | 55.6 | 123.7 |
| 38 | 24.8 | 131.6 |
| 39 | 13.5 | 64.7 |
| 40 | 26.3 | 79.5 |
| 41 | 29.0 | 66.5 |
| 42 | 21.9 | 73.3 |
| 43 | 6.0 | 55.2 |
| 44 | 4.3 | 39.1 |
| 45 | 9.6 | 45.4 |

Hot hardness of each sample alloy was measured in a Vickers type high temperature hardness tester at specific temperature. Ring specimens with 45 mm outer diameter, 32 mm inner diameter and 5 mm thickness were used as hot hardness specimens. All specimens were ground using 180, 400, and 600 SiC sand papers, then polished with 6 micro diamond paste and 0.02 micro alumina slurry, respectively. The specimen and the indenter were kept at 800° F. (427° C.) for 30 minutes under argon atmosphere to ensure uniform temperature in both the specimen and indenter. The Vickers indenter is made of sapphire with a 136° face angle. According to ASTM Standard Test Method E92082, 10 to 15 indentations were made along each ring specimen surface. The two indentation diagonals of each indentation were measured using a filar scale under a light microscope, and the values converted to Vickers hardness number using ASTM E140-78 Standard Hardness Conversion Table for Metals. All hot hardness samples are heat treated at 1200° F. for one hour and then liquid nitrogen chilled to remove any residual austenite. The hot hardness ratio is defined as hot hardness at 800° F. divided by room temperature hardness of the same sample alloy in order to compare hot hardness of sample alloys with different room temperature hardness. The hot hardness ratios of comparative sample alloy Nos. 3, 5, and 6 are between 0.7466 and 0.8209 while the ratios of most sample alloys of the invention are higher than those from comparative alloys. Sample alloy No. 10 with 6.0 wt % vanadium has a high value of the hot hardness ratio, indicating higher vanadium is beneficial to the hot hardness ratio, therefore, the upper limit of vanadium is set at 8.0 wt %. In sample alloy Nos. 11, 15, and 16, increasing niobium significantly increases hot hardness of sample alloys. Sample alloy No. 16 with 4.0 wt % niobium gives the highest hot hardness ratio among all sample alloys. Nickel shows its positive contribution to the hot hardness ratio as indicated in sample alloy Nos. 11, 15, and 16. In sample alloys Nos. 40 and 42, addition of cobalt to the inventive alloys also increases the hot hardness ratios of these sample alloys. Therefore, the upper limit of cobalt is set at 8.0 wt % in the inventive alloys.

TABLE 6

| Hot Hardness Results | | | |
|---|---|---|---|
| Sample Alloy | Hardness (RT) | Hardness (800 F.) | Hardness (RT)/ Hardness (800 F.) |
| 3 | 59.1 | 47.3 | 0.8003 |
| 5 | 66.7 | 49.8 | 0.7466 |
| 6 | 53.6 | 44.0 | 0.8209 |
| 10 | 54.9 | 47.2 | 0.8597 |
| 11 | 62.9 | 51.7 | 0.8219 |
| 15 | 62.0 | 53.1 | 0.8565 |
| 16 | 58.1 | 54.7 | 0.9415 |
| 22 | 59.8 | 51.4 | 0.8595 |
| 32 | 63.4 | 53.5 | 0.8438 |
| 34 | 57.6 | 48.5 | 0.8420 |
| 37 | 63.1 | 52.1 | 0.8257 |
| 40 | 60.3 | 53.0 | 0.8789 |
| 42 | 61.1 | 54.8 | 0.8969 |

It should be appreciated that the alloys of the present invention are capable of being incorporated in the form of a variety of embodiments, only a few of which have been illustrated and described. The invention may be embodied in other forms without departing from its spirit or essential characteristics. It should be appreciated that the addition of some other ingredients, process steps, materials or components not specifically included will have an adverse impact on the present invention. The best mode of the invention may, therefore, exclude ingredients, process steps, materials or components other than those listed above for inclusion or use in the invention. However, the described embodiments are considered in all respects only as illustrative and not restrictive, and the scope of the invention is, therefore, indicated by the appended claims rather than by the foregoing description. All changes that come within the meaning and range of equivalency of the claims are to be embraced within their scope.

What is claimed is:

1. A martensitic wear resistant iron base alloy with excellent hot hardness and wear resistance comprising:

a) about 2.05 to about 3.60 wt % carbon;

b) about 3.0 to about 10.0 wt % chromium;

c) about 0.1 to about 3.0 wt % silicon;

d) about 0 to about 8.0 wt % cobalt;

e) about 11.0 to about 25.0 wt % of molybdenum;

f) about 0.1 to about 6.5 wt % nickel;

g) about 0.0 to about 8.0 wt % vanadium;

h) about 0.0 to about 6.0 wt % niobium;

i) about 0 to about 2.0 wt % manganese;

j) less than 0.5 wt % aluminum; and k) the balance being iron and impurities, l) wherein i) the alloy has been tempered from an as-cast condition so that substantially all residual austenite is changed to martensite, ii) the alloy contains alloy carbides embedded in a matrix of tempered martensite, the alloy carbides consisting essentially of carbides formed during solidification from casting a melt of the alloy composition, and; iii) the alloy is capable of having, after being heat treated at a temperature of 1200° F. for one hour and then liquid nitrogen chilled, a hot hardness ratio, defined as hot hardness at 800° F. divided by room temperature hardness, of at least 0.8219.

2. An internal combustion engine component comprising the alloy of claim 1.

3. The alloy composition of claim 1 wherein the amount of carbon is between about 2.1 wt % and about 2.5 wt %.

4. The alloy composition of claim 1 wherein the amount of chromium is between about 6.0 wt % and about 10.0 wt %.

5. The alloy composition of claim 1 wherein the amount of silicon is between about 0.5 wt % and about 2.5 wt %.

6. The alloy composition of claim 1 wherein the amount of cobalt is between about 0 wt % and about 6.0 wt %.

7. The alloy composition of claim 1 wherein the amount of molybdenum is between about 14.0 wt % and about 18.0 wt %.

8. The alloy composition of claim 1 wherein the amount of nickel is between about 3.0 wt % and about 6.0 wt %.

9. The alloy composition of claim 1 wherein the amount of vanadium is between about 2.0 and about 6.0 wt %.

10. The alloy composition of claim 1 wherein the amount of niobium is between about 0.5 wt % and about 3.5 wt %.

11. The alloy composition of claim 1 wherein the amount of manganese is between about 0 and about 0.8 wt %.

12. The alloy composition of claim 1 wherein the amount of iron is greater than about 45.0 wt %.

13. A martensitic wear resistant iron base alloy with excellent hot hardness and wear resistance comprising:

a) about 2.05 to about 3.60 wt % carbon;
b) about 3.0 to about 12.0 wt % chromium;
c) about 0.1 to about 3.0 wt % silicon;
d) about 0.0 to about 8.0 wt % cobalt;
e) about 11.0 to about 25.0 wt % of molybdenum and tungsten, with the molybdenum content of the alloy being at least 11.0 wt %;
f) about 0.1 to about 6.5 wt % nickel;
g) about 0.0 to about 8.0 wt % vanadium;
h) about 0.0 to about 6.0 wt % niobium;
i) about 0 to about 2.0 wt % manganese;
j) less than 0.5 wt % aluminum; and
k) the balance being iron and impurities,
l) wherein i) the alloy has been tempered from an as-cast condition so that substantially all residual austenite is changed to martensite ii) the alloy contains alloy carbides embedded in a matrix of tempered martensite, the alloy carbides consisting essentially of carbides formed during solidification from casting a melt of the alloy composition, and; iii) the alloy is capable of having, after being heat treated at a temperature of 1200° F. for one hour and then liquid nitrogen chilled, a hot hardness ratio, defined as hot hardness at 800° F. divided by room temperature hardness, of at least 0.8219.

14. An internal combustion engine component comprising the alloy of claim 13.

15. The alloy composition of claim 13 wherein the amount of carbon is between about 2.1 wt % and about 2.5 wt %.

16. The alloy composition of claim 13 wherein the amount of chromium is between about 6.0 wt % and about 10.0 wt %.

17. The alloy composition of claim 13 wherein the amount of silicon is between about 0.5 wt % and about 2.5 wt %.

18. The alloy composition of claim 13 wherein the amount of cobalt is between about 0 wt % and about 6.0 wt %.

19. The alloy composition of claim 13 wherein the amount of molybdenum and tungsten is between about 14.0 wt % and about 18.0 wt %.

20. The alloy composition of claim 13 wherein the amount of nickel is between about 3.0 wt % and about 7.0 wt %.

21. The alloy composition of claim 13 wherein the amount of vanadium is between about 2.0 and about 6.0 wt %.

22. The alloy composition of claim 13 wherein the amount of niobium is between about 0.5 wt % and about 3.5 wt %.

23. The alloy composition of claim 13 wherein the amount of manganese is between about 0 and about 0.8 wt %.

24. The alloy composition of claim 13 wherein the amount of iron is greater than about 45.0 wt %.

25. The alloy composition of claim 1 wherein the alloy has a sliding wear rate of no greater than 11.7mg, as measured at 800° F. using ASTM G99-90 pin-on-disk wear testing at a velocity of 0.13m/s for 255m.

26. The alloy composition of claim 13 wherein the alloy has a sliding wear rate of no greater than 11.7mg, as measured at 8000F using ASTM G99-90 pin-on-disk wear testing at a velocity of 0.13m/s for 255m.

27. A method of making a cast product of a martensitic wear resistant iron base alloy with excellent hot hardness and wear resistance comprising:

a) making an alloy melt comprising
i) about 2.05 to about 3.60 wt % carbon;
ii) about 3.0 to about 10.0 wt % chromium;
iii) about 0.1 to about 3.0 wt % silicon;
iv) about 0 to about 8.0 wt % cobalt;
v) about 11 .0 to about 25.0 wt % of molybdenum;
vi) about 0.1 to about 6.5 wt % nickel;
vii) about 0.0 to about 8.0 wt % vanadium;
viii) about 0.0 to about 6.0 wt % niobium;
ix) about 0 to about 2.0 wt % manganese;
x) less than 0.5 wt % aluminum; and
xi) the balance being iron and impurities;
b) casting the alloy melt into a mold and allowing the alloy to solidify under conditions that form alloy carbides and a solid solution strengthened matrix of martensite and residual austenite in the solidified alloy, wherein the alloy is capable of having, after being heat treated at a temperature of 1200° F. for one hour and then liquid nitrogen chilled, a hot hardness ratio, defined as hot hardness at 800° F. divided by room temperature hardness, of at least 0.8219; and
c) tempering the solidified alloy under conditions such that substantially all residual austenite is changed to martensite, and the tempered product contains alloy carbides embedded in a matrix of tempered martensite.

28. The method of claim 27 wherein the product is machined into a component for an internal combustion engine.

29. The method of claim 27 wherein the alloy is capable of having a Rockwell C hardness at room temperature that does not exceed 63.4 after being tempered at a temperature of 1200° F. for one hour.

30. The alloy of claim 1 wherein the alloy is capable of having a Rockwell C hardness at room temperature that does not exceed 63.4 after being tempered at a temperature of 1200° F. for one hour.

31. The alloy of claim 13 wherein the alloy is capable of having a Rockwell C hardness at room temperature that does not exceed 63.4 after being tempered at a temperature of 1200° F. for one hour.

* * * * *

UNITED STATES PATENT AND TRADEMARK OFFICE

CERTIFICATE OF CORRECTION

PATENT NO. : 7,611,590 B2
APPLICATION NO. : 11/159548
DATED : November 3, 2009
INVENTOR(S) : Xuecheng Liang It is certified that error appears in the above-identified patent and that said Letters Patent is hereby corrected as shown below:

In column 12, claim 26, line 20, before "using ASTM" replace "8000F" with --800° F--.

Signed and Sealed this

Seventh Day of December, 2010

David J. Kappos

David J. Kappos
*Director of the United States Patent and Trademark Office*